US006984143B2

(12) United States Patent
Roese

(10) Patent No.: US 6,984,143 B2
(45) Date of Patent: Jan. 10, 2006

(54) LOCKABLE ELECTRICAL PLUG AND SOCKET CONNECTION

(75) Inventor: Frank Roese, Hamburg (DE)

(73) Assignee: Airbus Deutschland GmbH, Hamburg (DE)

( * ) Notice: Subject to any disclaimer, the term of this patent is extended or adjusted under 35 U.S.C. 154(b) by 0 days.

(21) Appl. No.: 11/003,954

(22) Filed: Dec. 3, 2004

(65) Prior Publication Data

US 2005/0124202 A1 Jun. 9, 2005

(30) Foreign Application Priority Data

Dec. 4, 2003 (DE) ..... 103 56 566

(51) Int. Cl.
*H01R 13/627* (2006.01)

(52) U.S. Cl. ..... 439/352; 439/357; 439/681; 439/701

(58) Field of Classification Search ..... 439/352, 439/357, 353, 358, 681, 701
See application file for complete search history.

(56) References Cited

U.S. PATENT DOCUMENTS 4,556,270 A 12/1985 Schutzle et al.
5,713,752 A * 2/1998 Leong et al. ..... 439/358
5,788,527 A * 8/1998 Sanders et al. ..... 439/352
5,997,333 A * 12/1999 Konda et al. ..... 439/352
6,059,598 A * 5/2000 Yamashita et al. ..... 439/352
6,065,991 A * 5/2000 Fukuda ..... 439/352
6,146,182 A * 11/2000 Wang et al. ..... 439/357
6,276,841 B1 * 8/2001 Demangone ..... 385/76
6,364,685 B1 * 4/2002 Manning ..... 439/357
6,383,032 B1 * 5/2002 Gerberding ..... 439/681
6,517,372 B1 2/2003 Jones
6,582,256 B2 * 6/2003 Sakurai et al. ..... 439/701
6,638,108 B2 * 10/2003 Tachi et al. ..... 439/595
6,666,728 B2 * 12/2003 Tachi et al. ..... 439/701
2005/0106924 A1 5/2005 Roese

FOREIGN PATENT DOCUMENTS

DE 3041938 6/1982

* cited by examiner

*Primary Examiner*—Gary Paumen
(74) *Attorney, Agent, or Firm*—W. F. Fasse; W. G. Fasse

(57) ABSTRACT

An electrical plug or socket has locking hooks on the ends of flexible locking arms extending from its housing. The other has locking receivers including open slots and catch rims on its housing. When the plug is connected with the socket, the locking arms extend into the slots and the locking hooks engage the catch rims to form a locked connection. The locking hooks protrude laterally outwardly, and yielding protrusions or lever arms protrude laterally inwardly, from the free ends or along the length of the locking arms. The lever arms and/or the free ends of the locking arms can contact and slide along outwardly sloping ramps of side-walls of the housing, to exert an outward locking force on the locking arms, and to achieve a disconnecting force that separates the plug from the socket when finger pressure is applied laterally inwardly to the free ends of the locking arms.

22 Claims, 4 Drawing Sheets

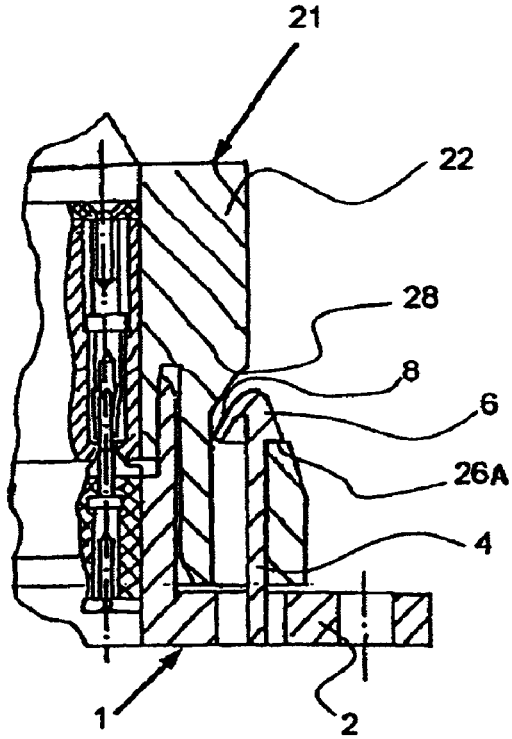
Fig. 8
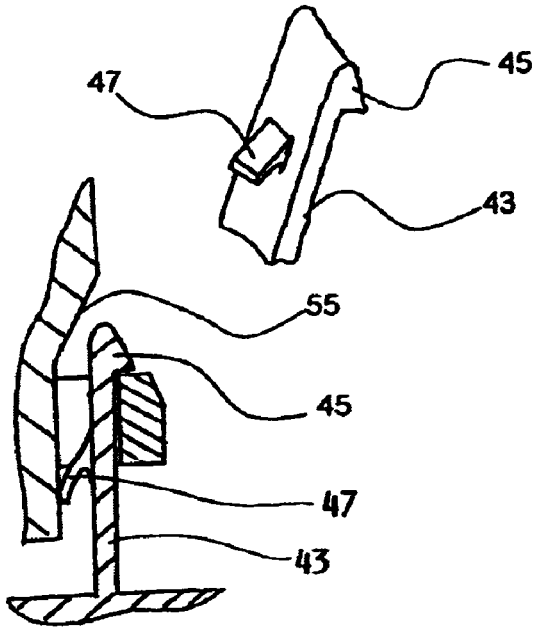
Fig. 9A
Fig. 9B

LOCKABLE ELECTRICAL PLUG AND SOCKET CONNECTION

PRIORITY CLAIM

This application is based on and claims the priority under 35 U.S.C. §119 of German Patent Application 103 56 566.3, filed on Dec. 4, 2003, the entire disclosure of which is incorporated herein by reference.

FIELD OF THE INVENTION

The invention relates to a lockable electrical connection established by an electrical plug and an electrical counter-plug or socket that can be selectively plugged together and locked.

BACKGROUND INFORMATION

It is generally known to provide an electrical connector plug and socket combination that can be plugged together and mechanically locked or latched to prevent an inadvertent disconnection or loosening thereof. For example, it is known to provide flexible arms having locking hooks on the ends thereof, on a housing of the connector plug, and to provide locking receivers or counter-recesses on the housing of the counter-plug or socket. When the plug and socket are plugged together, the locking hooks snap and engage into the locking receivers or counter-recesses. Thereby, the plug and socket are mechanically locked or securely held together.

Lockable electrical plug and socket connections of the above mentioned type are generally known, in principle, from the German Patent Publication DE 30 41 938 C2. Among other applications, such plug and socket connections are widely used in aircraft manufacturing technology.

In a modern conventional design of such an electrical plug and socket connection that is presently in use, the locking mechanism includes two locking hooks provided on opposite sides of the housing of the connector plug. Particularly, the locking hooks are provided and supported on flexible locking arms formed on the sides of the housing of the connector plug. These locking hooks are selectively unlockable or disengageable from the locking receivers of the socket by applying lateral finger pressure to the flexible locking arms, so as to deflect the flexible arms and thereby release the locking hooks from the locking receivers. Then, the plug and socket connection can be released and separated by pulling apart the plug and socket.

A comparable arrangement to that described above has also already become known from the U.S. Pat. No. 6,517,372 B1. Moreover, U.S. Pat. No. 6,065,991 A has already described and disclosed an electrical plug and socket connection, in which a spring-biased movable mechanism is provided with a positive constrained or enforced form-locking connection, which must again be released upon opening or separating the connection.

Furthermore, the U.S. Pat. No. 6,146,182 A has disclosed a lockable electrical plug and socket connection, in which flexible lever arms are provided on the locking arms for the purpose of producing an acoustic locking signal. Namely, when the locking arms become properly locked in place, the additional lever arms are to make a sound to indicate the proper locked connection.

Finally, U.S. Pat. No. 5,713,752 A has disclosed a lockable electrical plug and socket connection of the above described general type, in which springy or elastically deflectable lever arms are provided in addition to the locking hooks arranged at the ends of rigid locking arms. The lever arms are oriented opposite the locking hooks. The required locking force is applied via the lever arms. In order to release the locked condition achieved by the locking hooks, the spring force of the lever arms must be overcome.

SUMMARY OF THE INVENTION

In view of the above, it is an object of the invention to provide and further develop an electrical plug and socket connection of the above described general type, that achieves a high locking security of the connection in a simple manner and with simple means, and that further achieves an automatic separation of the two connectors, e.g. the connector plug and the connector socket, from each other triggered by the unlocking of the connection. The invention further aims to avoid or overcome the disadvantages of the prior art, and to achieve additional advantages, as apparent from the present specification. The attainment of these objects is, however, not a required limitation of the claimed invention.

The above objects have been achieved according to the invention in a lockable electrical connection comprising first and second connectors that can be selectively connected and disconnected with respect to one another, having the following features. The first connector includes a first housing, a first electrical contact in the first housing, and a deflectable locking arm structure extending from the first housing. The deflectable locking arm structure includes an elongated flexible deflectable locking arm, a locking hook that protrudes laterally from the locking arm, and a flexible yielding protrusion, especially a flexible lever arm, that protrudes laterally from the locking arm and is oriented opposite the locking hook. The second connector includes a second housing, a second electrical contact in the second housing, a locking receiver provided on the second housing, and a wall arrangement including a laterally outwardly sloping ramp wall provided on the second housing. The first and second electrical contacts are arranged and adapted to be brought into electrical contact with one another when the first connector and the second connector are connected together into a connected condition. The locking hook is arranged and adapted to be brought into engagement with the locking receiver in a locked condition when the first and second connectors are connected together in the connected condition, and the locking arm structure extends between the wall arrangement and the locking receiver. A part of the locking arm structure is arranged and adapted to be brought into contact with the sloping ramp wall. This part of the locking arm structure may include or be the flexible yielding protrusion, e.g. the flexible lever arm, or may be or include an end portion adjoining a free end of the locking arm.

More particularly, the locking receivers or counter-recesses of the second connector each include a straight linear wall as well as the outwardly sloping ramp wall opposite a catch rim of the locking receiver, with an open slot therebetween. The free end of each respective locking arm structure is configured, positioned, dimensioned, and arranged so as to contact and slide along the outwardly sloping ramp of the respective associated locking receiver when the locking hook at the end of this locking arm structure is released from the catch rim of the associated locking receiver by manually deflecting the flexible locking arm. Moreover, each locking arm structure further includes the protrusion preferably embodied as a lever arm protruding from the locking arm in a direction opposite the locking hook.

In one embodiment the lever arm is arranged at the end of the locking arm structure in such a manner so that the lever arm will come into contact with and slide along the outwardly sloping ramp wall of the respective associated locking receiver. In a second embodiment, the lever arm of a respective locking arm structure is not provided at the free end, but rather at a location along the length of the locking arm, so that the free end of the locking arm itself comes into contact with and slides along the outwardly sloping ramp wall of the associated locking receiver at the respective side of the housing.

In both cases, i.e. both embodiments, the respective lever arm provided at the end of the locking arm, or the end of the locking arm itself, by contacting and sliding along the sloping ramp wall or contact surface of the respective associated locking receiver arrangement of the other connector, achieve or at least reinforce a pushing-out and separation of the first connector (e.g. the connector plug or connector socket) from the second connector (e.g. the connector socket or connector plug). In other words, as a user of the connectors manually inwardly deflects the flexible locking arms to disengage the locking hooks from the catch rims of the locking receivers, the end portion of each locking arm structure contacting and sliding along the respective associated sloping ramp wall or contact surface of the locking receiver will "automatically" tend to push apart and separate the two connectors from each other.

Furthermore, the elastically flexible lever arms protruding opposite the locking hooks exert a high positive locking force or pressure outwardly onto the locking arms, to ensure a secure, positive outward locking of the locking hooks onto the respective catch rims of the respective associated locking receivers. Namely, in addition to the elastic spring return force of the flexible locking arms, the elastic spring return force of the flexible protrusions or lever arms also acts in a direction of enforcing the locking engagement of the locking hooks onto the catch rims of the locking receivers. In other words, the sum of both of these elastic forces (the force of the flexible locking arm and the force of the flexible lever arm on each side of the connector) acts in unison in the locking direction. Thereby, the holding force of the locked condition achieved according to the invention is significantly increased. Thereby also, the total locked condition is insensitive to shock and vibration loads, so that a possible unintended loosening and releasing of the locked condition is reliably prevented.

Furthermore, the inventive electrical plug and socket connection can achieve an extremely flat and shallow construction of the components and the overall assembled connection, that can be extremely easily released by manual finger pressure, and can also be easily and quickly plugged together and automatically locked by simply pushing and snapping together the connector components. Due to the flat or shallow structure, the inventive electrical connection makes it possible to significantly reduce the overall size of a component or unit, e.g. a so-called Seat Electronic Box in an aircraft, equipped with such an electrical connection. Also, the installation or assembly and especially also the disassembly of the electrical connection on the housing of such a unit is significantly simplified.

The connector components, e.g. the connector plug and connector socket, as well as the resulting electrical connection according to the invention are preferably designed and constructed to be very robust, to withstand rough handling thereof during installation, disassembly, reassembly, and at times therebetween. For example, during reconfiguration or re-equipping work in an aircraft, such as when reconfiguring the passenger class layout in an aircraft cabin, the electrical connections on Seat Electronic Boxes and the like must be released and removed, and must thereafter be reinstalled and reconnected at different locations. In the meantime, the connector member at the end of a cable may be temporarily lying on the aircraft cabin floor, where it might be stepped on or impacted by tools, various cabin components being moved in the cabin, or the like. Thus, the connector members must be robust to withstand such rough handling.

In order to achieve a great flexibility and adaptability of the electrical connection according to the invention, a further embodiment preferably provides that each connector member (e.g. connector plug or connector socket) includes a connector housing forming a connector body with a standardized recess or cavity into which a modular insert can be inserted as needed for a particular application. The modular insert includes a number of electrical contacts with a particular contact layout as needed for the application. Thus, the same connector housing or connector body can be used for various different particular electrical contact layout (e.g. number and arrangement of electrical contact pins and sockets). Furthermore, the electrical contacts of a connector member are not freely protruding, but rather are surrounded and protected by the respective connector housing.

BRIEF DESCRIPTION OF THE DRAWINGS

In order that the invention may be clearly understood, it will now be described in connection with example embodiments thereof, with reference to the accompanying drawings, wherein:

FIGS. 6 to 8 are detailed sectional views of a portion of an electrical connection established by a combination of the connector socket of FIG. 1 and the connector plug of FIG. 2, in three successive stages of locking (or unlocking) the connection;

FIG. 9A is a partial perspective view of a portion of a locking arm structure according to an alternative embodiment of the invention; and FIG. 9B is a sectional view of the locking arm structure according to the alternative embodiment of FIG. 9A engaging with the locking receiver of the mating connector.

Figure 1:
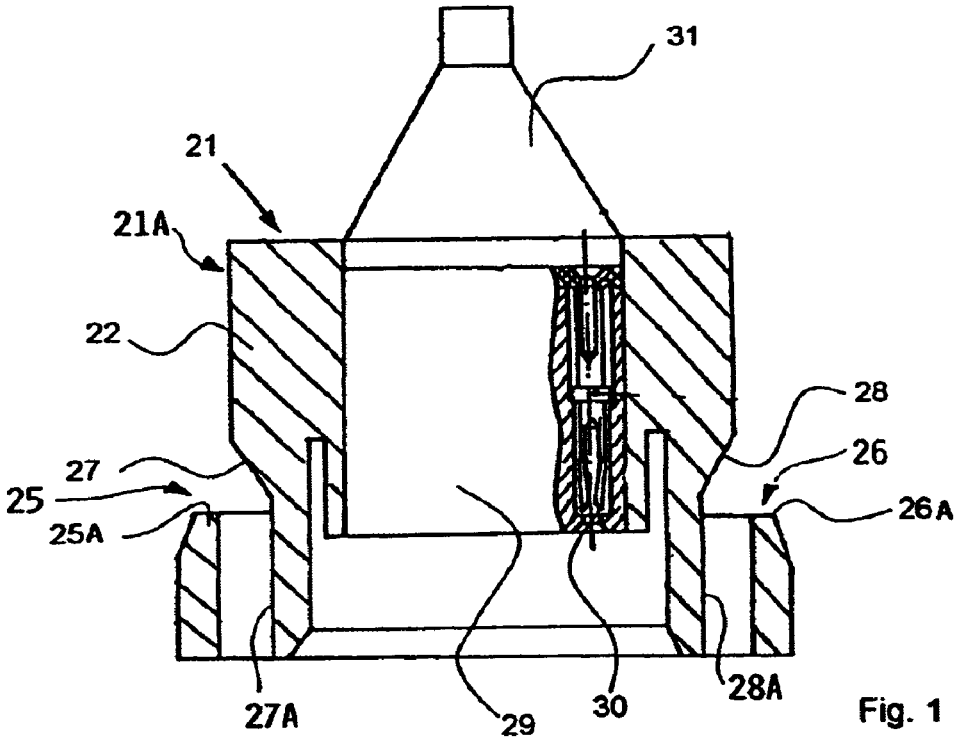
FIG. 1 is a schematic vertical sectional view through a second connector, e.g. a connector socket or counter-plug, according to the invention.
Figure 2:
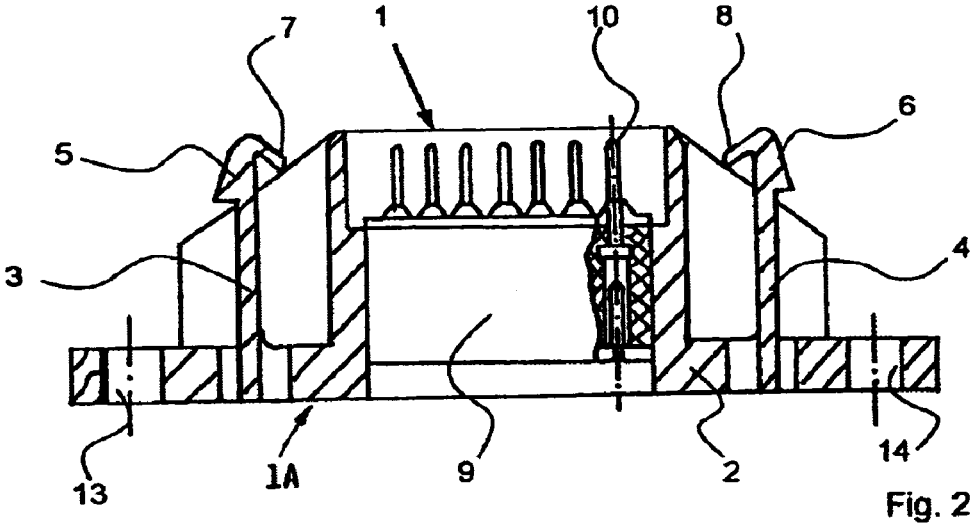
FIG. 2 is a schematic vertical sectional view through a first connector or connector plug according to the invention, associated and matable with the connector socket of FIG. 1 to form an electrical connection.
Figure 3:
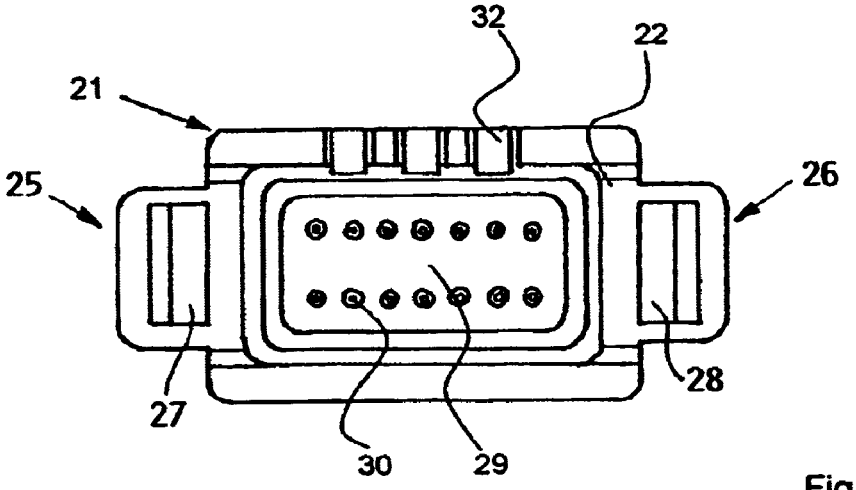
FIG. 3 is an end view of the contact arrangement of a connector socket.
Figure 4:
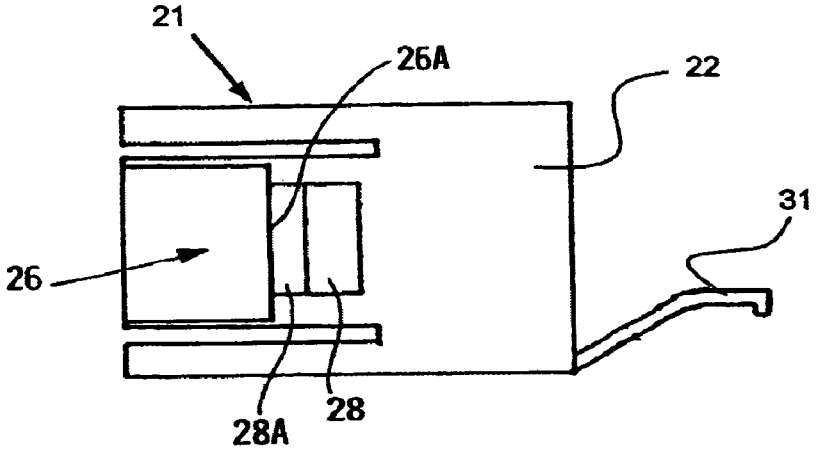
FIG. 4 is a side view of a connector socket.
Figure 5:
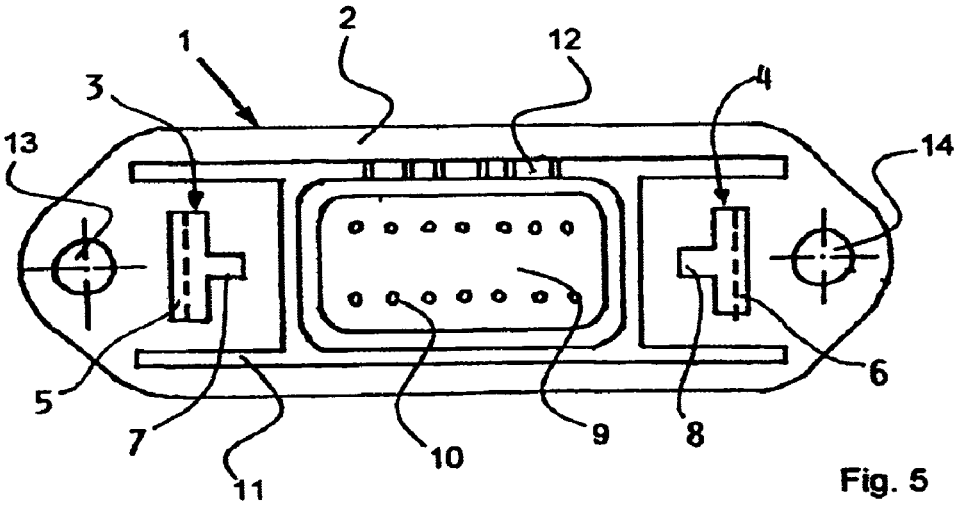
FIG. 5 is an end view of the contact arrangement of a connector plug.

DETAILED DESCRIPTION OF PREFERRED EXAMPLE EMBODIMENTS AND OF THE BEST MODE OF THE INVENTION

FIGS. 1 to 8 schematically represent various views and features of a first embodiment of an electrical connection according to the invention, including a first connector embodied as a connector plug 1 and an associated or mating second connector embodied as a connector socket or counter-plug 21.

The connector plug 1 comprises a body 1A including a housing 2 of an insulating material such as a plastic. The connector plug 1 further includes two locking arm structures extending from and preferably integrally and unitarily formed on the housing 2. The two locking arm structures respectively include elongated flexible locking arms 3 and 4, with locking hooks 5 and 6 formed on or adjacent to the respective free ends thereof, as well as elastically deflectable or yielding protrusions preferably embodied as flexible lever arms 7 and 8 also formed on or adjacent to the free ends of the two locking arms 3 and 4. Particularly, the locking hooks 5 and 6 protrude laterally outwardly away from a center plane of the housing 2, while the lever arms 7 and 8 protrude at an acute angle from the locking arms 3 and 4 generally laterally inwardly toward a center plane of the housing 2.

The connector socket 21 includes an insulating body 21A comprising a housing 22 of insulating material such as an insulating plastic. The connector socket 21 further comprises locking receivers or counter-recesses 25 and 26 that are positioned to cooperate with the locking arm structures of the connector plug 1 when the connector plug 1 and the connector socket 21 are plugged together. More particularly, the locking receivers 25 and 26 respective comprise openings or slots that are bounded by a catch rim 25A or 26A on the laterally outer side and by a housing wall including a straight linear wall 27A or 28A as well as an outwardly sloping ramp wall 27 or 28 on the laterally inward side. These openings or slots are dimensioned and positioned so that the locking arm structures including the locking hooks 5 and 6, the lever arms 7 and 8, and the locking arms 3 and 4, are inserted into these slots as the connector plug 1 and connector socket 21 are being plugged together.

Figure 6:
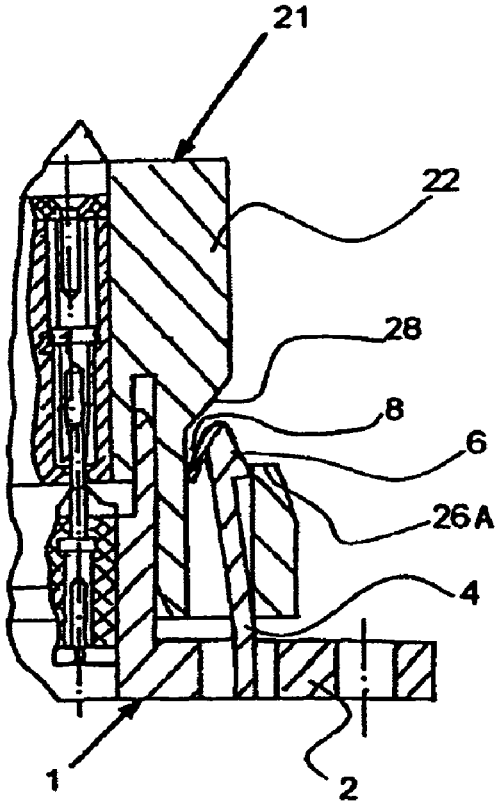
Figure 7:
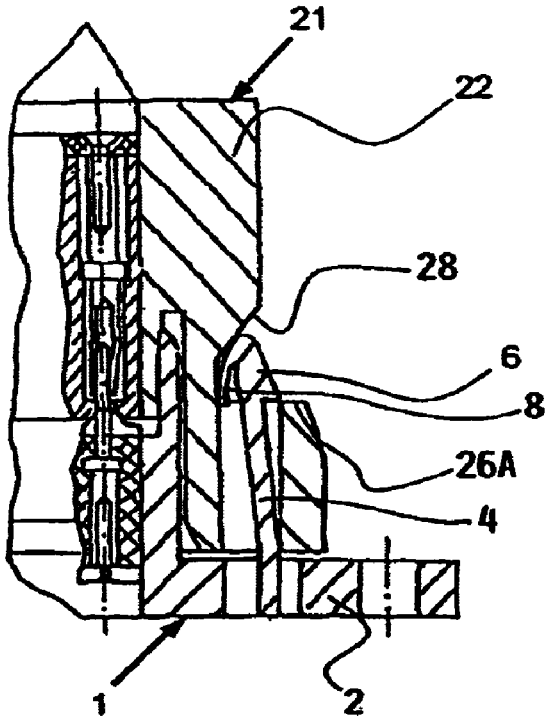

FIGS. 6, 7 and 8 show three successive stages of a representative locking arm structure being inserted into the associated locking receiver (or in reverse, being removed therefrom). As can be seen, the free end of the locking arm structure including the locking hook 6 and the yielding protrusion or lever arm 8 is first slidingly inserted into the open slot of the locking receiver 26, while the lever arm 8 slides along the straight linear wall 28A, as shown in FIG. 6. Then, just as the free end of the locking arm 4 and/or the lever arm 8 provided thereon begins to be urged laterally outwardly by contacting and sliding along the outwardly sloping ramp 28 as shown in FIG. 7, the locking hook 6 reaches behind and then engages or "snaps" behind the catch rim 26A of the locking receiver 26, to reach the locked position as shown in FIG. 8.

In this locked position, the locking hook 6 is locked behind the catch rim 26A of the locking receiver 26, the locking arm 4 is in its straight-extending neutral position, and the lever arm 8 exerts a laterally outwardly directed locking force to maintain the locking hook 6 in the outwardly deflected locked position. Note that FIGS. 6 to 8 show the lever arm 8 always bearing against the straight linear wall 28A and not directly contacting or bearing against the outwardly sloping ramp wall 28. However, a further alternative embodiment has the straight linear wall 28A somewhat shorter and the sloping ramp wall 28 shifted downwardly in comparison to FIGS. 6 to 8, so that the lever arm 8 contacts, bears against, and is urged outwardly along the sloping ramp wall 28.

The locking arm structure including the locking arm 3, the locking hook 5, and the lever arm 7 as well as the associated locking receiver 25 on the opposite side of the connectors 1 and 21 is configured and operates mirror-symmetrically with respect to the components shown in FIGS. 6 to 8, simultaneously while the connectors 1 and 21 are being plugged together.

In the locked condition shown in FIG. 8, the elastic recovery force of the locking arm 4, as well as the laterally outwardly directed elastic recovery force of the lever arm 8 together exert a force in a direction serving to hold or maintain the locked condition, i.e. with the locking hook 6 engaged behind the catch rim 26A, securely and reliably even if the established connection is subjected to vibrations, shocks, or the like. For this purpose, the lever arms 7 and 8 are configured and structurally arranged so that they always remain in the elastic range of the material, throughout the entire range of deflection encountered during connection and disconnection of the two connectors 1 and 21, so that the lever arms 7 and 8 always exert a constant laterally outwardly directed elastic locking force. Moreover, as described above, the two outwardly sloping ramp walls 27 and 28 provided on the housing 22 of the connector socket 21 further exert an outwardly directed locking force on the elastic lever arms 7 and 8 and/or on the locking arms 3 and 4.

In FIGS. 6 and 7, the locking arms 3 and 4 are fully deflected and the integrated lever arms 7 and 8 are half-deflected and thus elastically stressed. Moreover, the condition of FIG. 7 arises when finger pressure is being applied laterally inwardly onto the locking arm structures (to release the locked condition), so that the lever arms 7 and 8 are maximally elastically deflected. If the FIGS. 6 to 8 are considered in reverse order, they represent the sequence of releasing or unlocking the locked condition, as follows.

When the electrical connection is to be disconnected or disassembled, i.e. when the connector plug 1 is to be removed from the connector socket 21 or vice versa, it is simply necessary to apply a laterally inwardly directed manual finger pressure onto the exposed free ends of the locking arm structures, i.e. onto the locking hooks 5 and 6. By "pinching" together the locking hooks 5 and 6 laterally inwardly in this manner, the lever arms 7 and 8 are elastically depressed, and the lever arms 7 and 8 or the free ends of the locking arms 3 and 4 are pressed laterally inwardly against the sloping surfaces of the sloping ramp walls 27 and 28, into the position shown in FIG. 7.

This interaction of the locking arm structures with the sloping ramp walls 27 and 28 exerts a laterally outwardly directed reaction force component as well as an axially or longitudinally directed force component (e.g. perpendicular to the laterally inward squeezing or pinching force). The latter force component tends to "automatically" separate the connector socket 21 from the connector plug 1 or vice versa. Namely, as the user of the inventive electrical connection squeezes together the free ends of the locking arms 3 and 4 with finger pressure (or laterally inward pressure applied by an appropriate tool such as suitable pliers), the connector socket 21 will simultaneously be ejected or pushed away from the connector plug 1 (due to the part of each locking arm structure contacting and sliding along the associated ramp wall), whereby the connection is "automatically" released and separated.

In the above context, the lever arms 7 and 8 as well as the angle and position of the associated sloping ramp walls 27 and 28 are arranged, designed, and constructed in such a manner so as to achieve a secured locking of the locking hooks 5 and 6 on the catch rims 25A and 26A in the locked condition, yet allow a rapid and simple release thereof as described above without requiring more than manual finger pressure or the like.

Preferably, the locking arm structures including the locking arms 3 and 4, the locking hooks 5 and 6, and the lever arms 7 and 8 may be integrally and unitarily molded with the housing 2 of an insulating plastic material. Alternatively, the locking arm structures may be separate components that are secured to the housing 2, or the lever arms 7 and 8 may be separate components that are separately arranged, secured or added onto the locking arms 3 and 4.

In order to reduce the structural height or depth of the connector components to the extent possible, the components 1 and 21 preferably have a rectangular block-shaped basic shape, particularly comprising the bodies 1A and 21A as mentioned above. Furthermore, to achieve a modular construction whereby the bodies 1A and 21A can be used consistently for various different electrical connection applications, the bodies 1A and 21A respectively have standardized cavities therein adapted to receive electrical connector inserts 9 and 29 that may have any required number and layout of electrical contacts as needed for the particular application. For example, the electrical connector insert 9 for the connector plug 1 includes a plurality of contact pins 10 in an insulating insert body, while the electrical connector insert 29 for the connector socket 21 includes a corresponding plurality of electrical contact sockets 30 arranged in a mating contact layout in an electrically insulating insert body. These inserts 9 and 29 are inserted and locked into the respective cavities of the connector housings 2 and 22. Moreover, the connectors 1 and 21 are configured so that they can alternatively as required receive either a modular insert 9 with contact pins 10 or a modular insert 29 with contact sockets 30.

In any event, the respective electrical contacts 10 and 30 are laterally protected by the associated surrounding connector housing 2 or 22. Furthermore, the housing 2 of the connector plug 1 preferably has longitudinally extending protective walls or wall extensions 11 extending laterally so as to protect the locking arms 3 and 4, so that forces acting perpendicular to the lateral deflection direction of the locking arms 3 and 4, e.g. due to mishandling of the connector members, will not impinge on or damage the locking arms 3 and 4.

Furthermore, both connector members or components 1 and 21 have coding elements 12 and 32 in the form of inter-engaging coding grooves and studs or ridges provided on the mating end faces thereof. These coding elements 12 and 32 include studs or ridges that can be removed or broken away in a defined manner along suitable defined breakage or frangible locations, so that various different coding patterns can be realized simply by breaking away different combinations of the studs or ridges. For example, plastic material of the housing in the area of the coding elements 12 and 32 can simply be broken away. Alternatively, different coding patterns of the coding elements 12 and 32 can be achieved using exchangeable inserts in the injection molds used for producing the injection-molded housings 2 and 22. In any event, the coding elements 12 and 32 are provided or arranged in mutually mating patterns, so that the connector plug 1 can be mated with the proper associated connector socket 21. On the other hand, a connector plug or connector socket of a different connection, e.g. of a different electrical cable, will have a different coding pattern and thus will not mate properly with a connector element of the subject connection.

The housing 22 of the connector socket 21 is further supplemented and completed by a tension or stress relief 31 (to be connected to the electrical cable for relieving stress thereof). The housing 2 of the connector plug 1 is supplemented and completed by protruding mounting flanges or tabs with securing holes 13 and 14, through which securing screws or the like can be passed to mount or secure the connector plug 1 at the intended installation location.

FIGS. 9A and 9B show a detailed portion of an alternative embodiment in comparison to the embodiment of FIGS. 1 to 8. In this embodiment of FIGS. 9A and 9B, a yielding protrusion or lever arm 47 is integrally arranged on a locking arm 43 at a location lower down than the lever arm 8 provided on the locking arm 4 in FIGS. 6 to 8. Namely, the lever arm 47 is provided along a middle portion of the length of the locking arm 43 rather than at the free end portion of the locking arm 43 opposite the locking hook 45. Thus, not the lever arm 47, but rather the free end itself of the locking arm 43 contacts and slides along the sloping ramp wall 55. Note that the free end or head of the locking arm 43 may be rounded or tapered so as to smoothly contact and slide along the sloping ramp wall 55 in this regard.

In this manner, similarly as described above in connection with FIGS. 6 and 8, the interaction between the locking arm structure and the sloping ramp wall 55 exerts an increased laterally outwardly directed locking force onto the locking hook 45, and also may provide an axially or longitudinally directed "automatic" decoupling force for separating the connector socket from the connector plug when finger pressure is applied laterally inwardly to the locking hook 45. On the other hand, the lever arm 47 does not contact and slide along the sloping ramp wall 55, but rather only against the straight linearly extending wall. Depending on the particular arrangement of the sloping ramp relative to the free end of the locking arm structure, the "automatic" separating or disconnecting function may be omitted, i.e. if the free end of the locking arm structure does not contact and slide along the sloping ramp when finger pressure is applied to unlock the locked connection.

The described connector members can be embodied either in the form of a so-called Panel Mount Version or in a so-called Circuit Board Version that is angled by 90°. In the Panel Mount Version, the connector plug is secured on the device housing, and the cabling or conductive cable connection is achieved via conductor lines to an associated circuit board. On the other hand, in the Circuit Board Version, the contacts of the connector plug are soldered directly onto the circuit board and the connector plug is secured directly onto the circuit board. Then, the device housing is pushed or slid over the plug housing in grooves provided for this purpose, and secured to the circuit board.

It should be understood that the locking arm structures may be provided either on the connector plug or on the connector socket or counter-plug according to the invention.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. A lockable electrical connection comprising first and second connectors that can be selectively connected and disconnected with respect to one another, wherein:

said first connector includes a first housing, a first electrical contact in said first housing, and a deflectable locking arm structure extending from said first housing;

said deflectable locking arm structure includes an elongated flexible deflectable locking arm, a locking hook that protrudes laterally from said locking arm, and a flexible yielding protrusion comprising a flexible lever arm that protrudes laterally from said locking arm oriented opposite said locking hook;

said second connector includes a second housing, a second electrical contact in said second housing, a locking receiver provided on said second housing, and a wall arrangement including a laterally outwardly sloping ramp wall provided on said second housing;

said first and second electrical contacts are arranged and adapted to be brought into electrical contact with one another when said first connector and said second connector are connected together into a connected condition;

said locking hook is arranged and adapted to be brought into engagement with said locking receiver in a locked condition when said first and second connectors are connected together in said connected condition, and said locking arm structure extends between said wall arrangement and said locking receiver;

a part of said locking arm structure is arranged and adapted to be brought into contact with said sloping ramp wall; and in said locked condition, said flexible lever arm bears against said wall arrangement and is thereby elastically deflected and exerts a first elastic flexing return force onto said locking arm in a direction biasing said locking hook toward said engagement with said locking receiver.

2. The lockable electrical connection according to claim 1, wherein said first connector is a connector plug and said second connector is a connector socket.

3. The lockable electrical connection according to claim 1, wherein said part of said locking arm structure adapted to be brought into contact with said sloping ramp wall comprises said flexible lever arm.

4. The lockable electrical connection according to claim 3, wherein said flexible lever arm and said locking hook are respectively arranged on opposite lateral sides of an end portion adjoining a free end of said locking arm.

5. The lockable electrical connection according to claim 3, wherein said flexible lever arm is arranged directly adjoining a free end of said locking arm.

6. The lockable electrical connection according to claim 3, wherein said flexible lever arm is arranged closer than said locking hook to a free end of said locking arm.

7. The lockable electrical connection according to claim 1, wherein said part of said locking arm structure adapted to be brought into contact with said sloping ramp wall comprises an end portion adjoining a free end of said locking arm.

8. The lockable electrical connection according to claim 7, wherein said yielding protrusion does not contact said sloping ramp wall.

9. The lockable electrical connection according to claim 7, wherein said yielding protrusion is arranged farther than said locking hook from said free end of said locking arm.

10. The lockable electrical connection according to claim 1, wherein said yielding protrusion is arranged closer than said locking hook to a free end of said locking arm.

11. The lockable electrical connection according to claim 1, wherein said yielding protrusion is arranged farther than said locking hook from a free end of said locking arm.

12. The lockable electrical connection according to claim 1, wherein said flexible lever arm extends laterally from said locking arm at an acute angle with a vertex oriented toward a free end of said locking arm.

13. The lockable electrical connection according to claim 1, wherein said yielding protrusion is oriented laterally inwardly toward a center plane of said first housing and said second housing, and said locking hook is oriented laterally outwardly away from said center plane.

14. The lockable electrical connection according to claim 1, comprising two of said locking arm structures mirror-symmetrically arranged respectively on opposite sides of said first housing, as well as two of said locking receivers and two of said wall arrangements mirror-symmetrically arranged respectively on opposite sides of said second housing.

15. The lockable electrical connection according to claim 1, wherein said wall arrangement further includes a straight linear wall that extends substantially parallel to said locking arm in said locked condition and that leads to and adjoins said sloping ramp wall from a front end of said second housing facing toward said first connector.

16. The lockable electrical connection according to claim 1, wherein said locking receiver includes a catch rim behind which said locking hook is engaged in said locked condition, and an open slot is formed between said locking receiver and said wall arrangement and is adapted to have said locking arm structure inserted therein.

17. The lockable electrical connection according to claim 1, wherein said part of said locking arm structure contacting said sloping ramp wall exerts a first force component urging said locking hook laterally outwardly and a second force component urging said first connector via said locking arm structure away from and out of said connected condition with respect to said second connector.

18. The lockable electrical connection according to claim 1, wherein said locking arm structure is integrally unitarily formed and integrated with said first housing.

19. The lockable electrical connection according to claim 1, wherein said first housing has a first cavity therein, said first connector further includes a first modular insert selectively and releasably received in said first cavity and holding said first electrical contact, said second housing has a second cavity therein, and said second connector further includes a second modular insert selectively and releasably received in said second cavity and holding said second electrical contact.

20. The lockable electrical connection according to claim 19, wherein one of said first and second electrical contacts is a contact pin and the other of said first and second electrical contacts is a contact socket adapted to matingly receive said contact pin, and wherein said first and second cavities and said first and second modular inserts have mutually compatible dimensions and configurations so that either of said modular inserts can be selectively received in either of said cavities.

21. The lockable electrical connection according to claim 1, wherein said first connector further includes first coding elements comprising first grooves and first elevations, said second connector further includes second coding elements comprising second grooves and second elevations adapted to mate with said first elevations and said first grooves, and selected ones of said elevations may be removed at frangible locations to form a selected coding pattern of said grooves and elevations.

22. The lockable electrical connection according to claim 1, wherein said locking arm is elastically deflected and exerts a second elastic flexing return force in said direction biasing said locking hook toward said engagement with said locking receiver, so that said first and second elastic flexing return forces both additively reinforce and secure said engagement of said locking hook with said locking receiver.

* * * * *